US007007820B1

(12) United States Patent
Cumer

(10) Patent No.: US 7,007,820 B1
(45) Date of Patent: Mar. 7, 2006

(54) DENTAL HYGIENE VENDING MACHINE

(76) Inventor: Judith A. Cumer, 305 Walker La., Washington, PA (US) 15301

( * ) Notice: Subject to any disclaimer, the term of this patent is extended or adjusted under 35 U.S.C. 154(b) by 184 days.

(21) Appl. No.: 10/306,472

(22) Filed: Nov. 27, 2002

(51) Int. Cl.
*G07F 11/00* (2006.01)

(52) U.S. Cl. ..... 221/75; 221/89; 221/90; 221/124; 221/133; 221/155

(58) Field of Classification Search ..... 221/75, 221/89, 90, 124, 129, 133, 155, 2, 283
See application file for complete search history.

(56) References Cited

U.S. PATENT DOCUMENTS 3,248,005 A * 4/1966 Joschko ..... 221/13
3,344,953 A * 10/1967 Krakauer et al ..... 221/75
3,601,281 A * 8/1971 Schlaf ..... 221/75
4,023,704 A * 5/1977 Pitel et al. ..... 221/75
4,211,330 A * 7/1980 Strock ..... 206/581
4,972,946 A * 11/1990 Whittaker ..... 206/210
5,337,876 A * 8/1994 McGee et al. ..... 194/236
5,360,134 A * 11/1994 Falk et al. ..... 221/2
5,553,736 A * 9/1996 Healis ..... 221/62
5,570,809 A * 11/1996 Martin ..... 221/73
5,752,622 A * 5/1998 Abell ..... 221/97
6,478,187 B1 * 11/2002 Simson et al. ..... 221/75
6,553,703 B1 * 4/2003 Fowler et al. ..... 40/666

* cited by examiner

*Primary Examiner*—David H. Bollinger

(57) ABSTRACT

A dental hygiene vending machine comprises a housing having multiple dispensing compartments. A dispensing coil is rotatably connected to the housing and is capable of actuation. A cover is hingedly connected to the housing. The cover has multiple cutouts that substantially align with the housing dispensing compartments. An item window is attached to the cover. Multiple dispensing switches are slidably connected to the cover. A change counter is connected to the housing and has a coin slot. The change counter is electrically connected to the dispensing switches and is capable of actuating the dispensing coil when a predetermined value of change is received in the coin slot.

4 Claims, 3 Drawing Sheets

DENTAL HYGIENE VENDING MACHINE

BACKGROUND OF THE INVENTION

1. Field of the Invention

The present invention relates to a dental hygiene vending machine for use in connection with oral health and hygiene holders. The dental hygiene vending machine has particular utility in connection with vending machine for dispensing dental hygiene products and the like.

2. Description of the Prior Art

Dental hygiene vending machines are desirable to provide a convenient means to practice oral hygiene and freshen one's breath when away from home.

The use of oral health and hygiene holders are known in the prior art. For example, U.S. Pat. No. 2,308,319 to Stanley discloses a toilet or travelling case of leather or like material. The case comprises a base section adapted to rest flatly on a support or table, a top section of substantially the same length and width as the base section. A back strip connects the base and top section and of a width corresponding to the thickness of the closed case. Flexible rim flanges enclose the ends and front of the case when closed, the sections have interior holding means for removably mounting various articles or accessories thereon. The sections and the strip being each relatively stiff but with a flexible joint or hinge between the base section and the back strip about which the case may be swung open or closed. A stiffening means other than the rim flanges comprising an angle pice of stiff sheet material or L-shape cross section embodied in the back strip and top section with one of its walls coinciding and embodied in the plane of the the back strip and its other wall coinciding and embodied in the plane of the top section. When the case is open the base section and the back strip rest flatly on the support while the top section upstands firmly approximately vertically therefrom and the articles mounted on both sections are accessibly displayed. However, the Stanley '319 patent does not disclose a vending machine for dental hygiene products.

Similarly, U.S. Pat. No. 4,972,946 to Whittaker discloses a disposable dental hygiene kit including a sealed flat rectangular package formed of a pair of foil lined synthetic plastic sheets sealed together around all the edges thereof and having an end portion which is tearable to open the package. Within the package is a synthetic felt pad about 3.5 by 7.0 by 0.2 cm. folded once to form a square; within the folded synthetic felt pad is approximately 30 cm. of unwaxed dental floss wound on a plastic or paper spindle about 3 cm. by 1 cm. The pad is impregnated with about two cc of liquid consisting of water, about 15% alcohol, and a dentafrice consisting of one or more of the substances thymol, eucalyptol, menthol or benzoic acid. As an alternative to the spindle for the dental floss, the floss may be contained in a transparent plastic bag about 2.5 by 3.0 cm. or may simply be wound in a flat spiral coil. The kit is used by tearing open one end, removing and using the dental floss in a customary manner, and wiping the teeth with the felt pad in lieu of a toothbrush. However, the Whittaker '946 patent does not disclose a vending machine for dental hygiene products.

Lastly, U.S. Pat. No. 4,211,330 to Strock discloses an oral health and hygiene holders kit comprises a length of flexible liquid pervious material, said length of material including a pocket for containing a finger. A dentifrice is applied to an exterior face of the pocket. Also the length of material extends longitudinally away from the opening into the pocket and a transverse sleeve is formed in the extension for containing a length of dental floss and a relatively rigid dental stimulator. However, the Strock '330 patent does not disclose a vending machine for dental hygiene products.

While the above-described devices fulfill their respective, particular objectives and requirements, the aforementioned patents do not describe a dental hygiene vending machine that allows vending machine for dispensing dental hygiene products and the like. The Stanley '319, Whittaker '946 and Strock '330 patents make no provision for disclose a vending machine for dental hygiene products.

Therefore, a need exists for a new and improved dental hygiene vending machine which can be used for vending machine for dispensing dental hygiene products and the like. In this regard, the present invention substantially fulfills this need. In this respect, the dental hygiene vending machine according to the present invention substantially departs from the conventional concepts and designs of the prior art, and in doing so provides an apparatus primarily developed for the purpose of vending machine for dispensing dental hygiene products and the like.

SUMMARY OF THE INVENTION

In view of the foregoing disadvantages inherent in the known types of oral health and hygiene holders now present in the prior art, the present invention provides an improved dental hygiene vending machine, and overcomes the above-mentioned disadvantages and drawbacks of the prior art. As such, the general purpose of the present invention, which will be described subsequently in greater detail, is to provide a new and improved dental hygiene vending machine and method which has all the advantages of the prior art mentioned heretofore and many novel features that result in a dental hygiene vending machine which is not anticipated, rendered obvious, suggested, or even implied by the prior art, either alone or in any combination thereof.

To attain this, the present invention essentially comprises a housing having multiple dispensing compartments. A dispensing coil is rotatably connected to the housing and is capable of actuation. A cover is hingedly connected to the housing. The cover has multiple cutouts that substantially align with the housing dispensing compartments. An item window is attached to the cover. Multiple dispensing switches are slidably connected to the cover. A change counter is connected to the housing and has a coin slot. The change counter is electrically connected to the dispensing switches and is capable of actuating the dispensing coil when a predetermined value of change is received in the coin slot.

There has thus been outlined, rather broadly, the more important features of the invention in order that the detailed description thereof that follows may be better understood and in order that the present contribution to the art may be better appreciated.

The invention may also include a change return slot, a hanging slot, an amount indicator, a change return switch, a dispensing door, a price display a lock box and a lock box lock. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dental hygiene vending machine that has all of the advantages of the prior art oral health and hygiene holders and none of the disadvantages.

It is another object of the present invention to provide a new and improved dental hygiene vending machine that may be easily and efficiently manufactured and marketed.

An even further object of the present invention is to provide a new and improved dental hygiene vending machine that has a low cost of manufacture with regard to both materials and labor, and which accordingly is then susceptible of low prices of sale to the consuming public, thereby making such dental hygiene vending machine economically available to the buying public.

Still another object of the present invention is to provide a new dental hygiene vending machine that provides in the apparatuses and methods of the prior art some of the advantages thereof, while simultaneously overcoming some of the disadvantages normally associated therewith.

Even still another object of the present invention is to provide a dental hygiene vending machine for vending machine for dispensing dental hygiene products and the like.

Lastly, it is an object of the present invention is to provide a dental hygiene vending machine to provide convenient means to practice oral hygiene and freshen one's breath when away from home.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
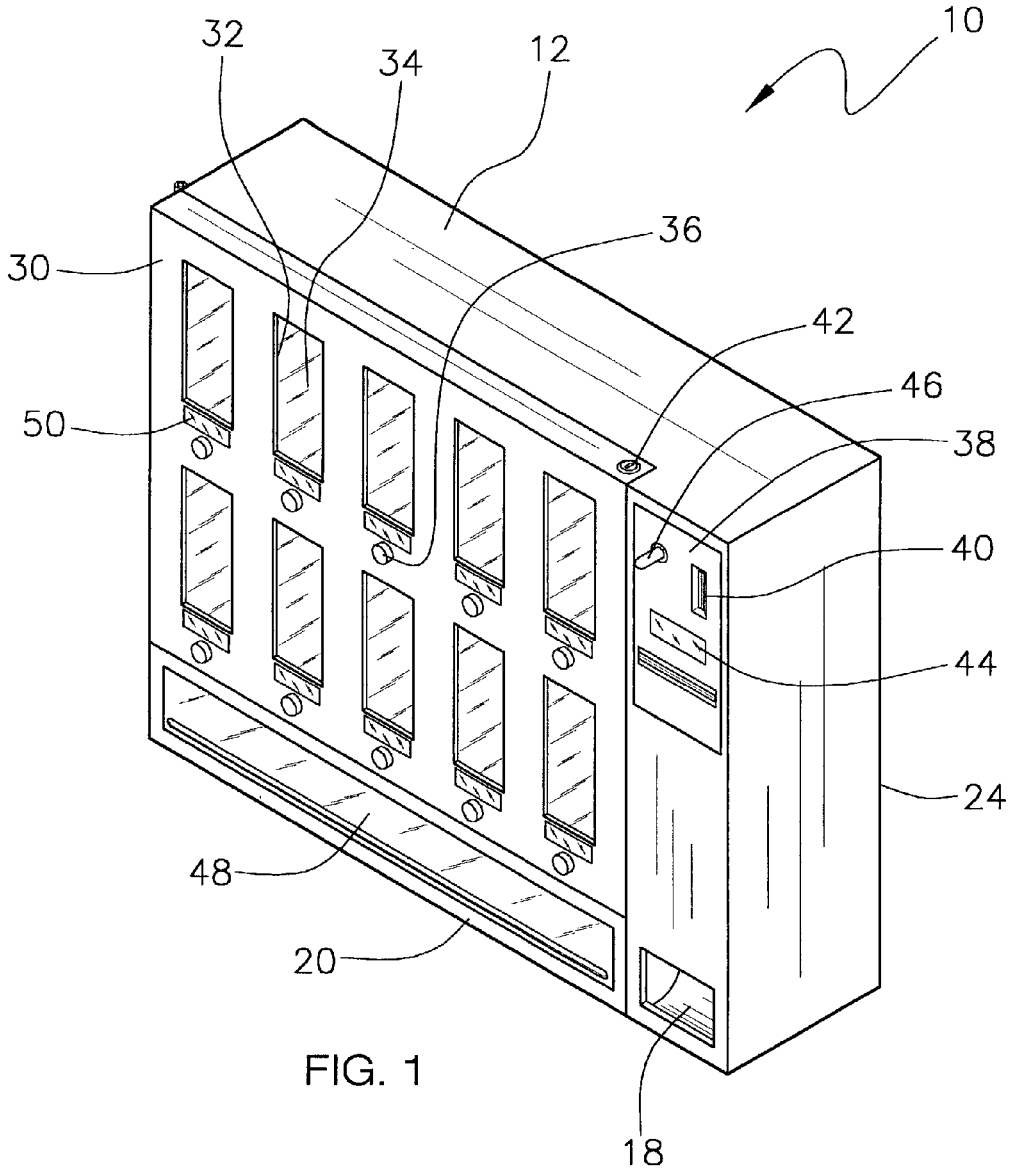
FIG. 1 is a top perspective view of the preferred embodiment of the dental hygiene vending machine constructed in accordance with the principles of the present invention.

Referring now to the drawings, and particularly to FIGS. 1–4, a preferred embodiment of the dental hygiene vending machine of the present invention is shown and generally designated by the reference numeral 10.

In FIG. 1, a new and improved dental hygiene vending machine 10 of the present invention for vending machine for dispensing dental hygiene products and the like is illustrated and will be described. More particularly, the dental hygiene vending machine 10 has a housing 12 has a plurality of dispensing compartments 14 (shown in FIG. 2) therein. The housing dispensing compartments 14 have a bottom 16. The housing 12 has a change return slot 18 therein. The housing 12 has a bottom portion 20. A cover 30 is hingedly connected to the housing 12. The cover 30 has a plurality of cutouts 32 that substantially align with the housing dispensing compartments 14. A item window 34 is attached to the cover 30. A plurality of dispensing switches 36 are slidably connected to the cover 30. A change counter 38 is connected to the housing 12. The change counter 38 has a coin slot therein 40. A cover lock 42 is connected to the cover 30 is capable of locking the cover 30 to the housing 12. An amount indicator 44 is connected to the change counter 38 and is capable of displaying the value of change placed within the coin slot 40. A change return switch 46 is connected to the change counter 38 for returning coins inserted into the coin slot 40. A dispensing door 48 is hingably connected to the cover 30. A price display 50 is connected to the cover 30. The price display 50 is electrically connected to the change counter 38.

Figure 2:
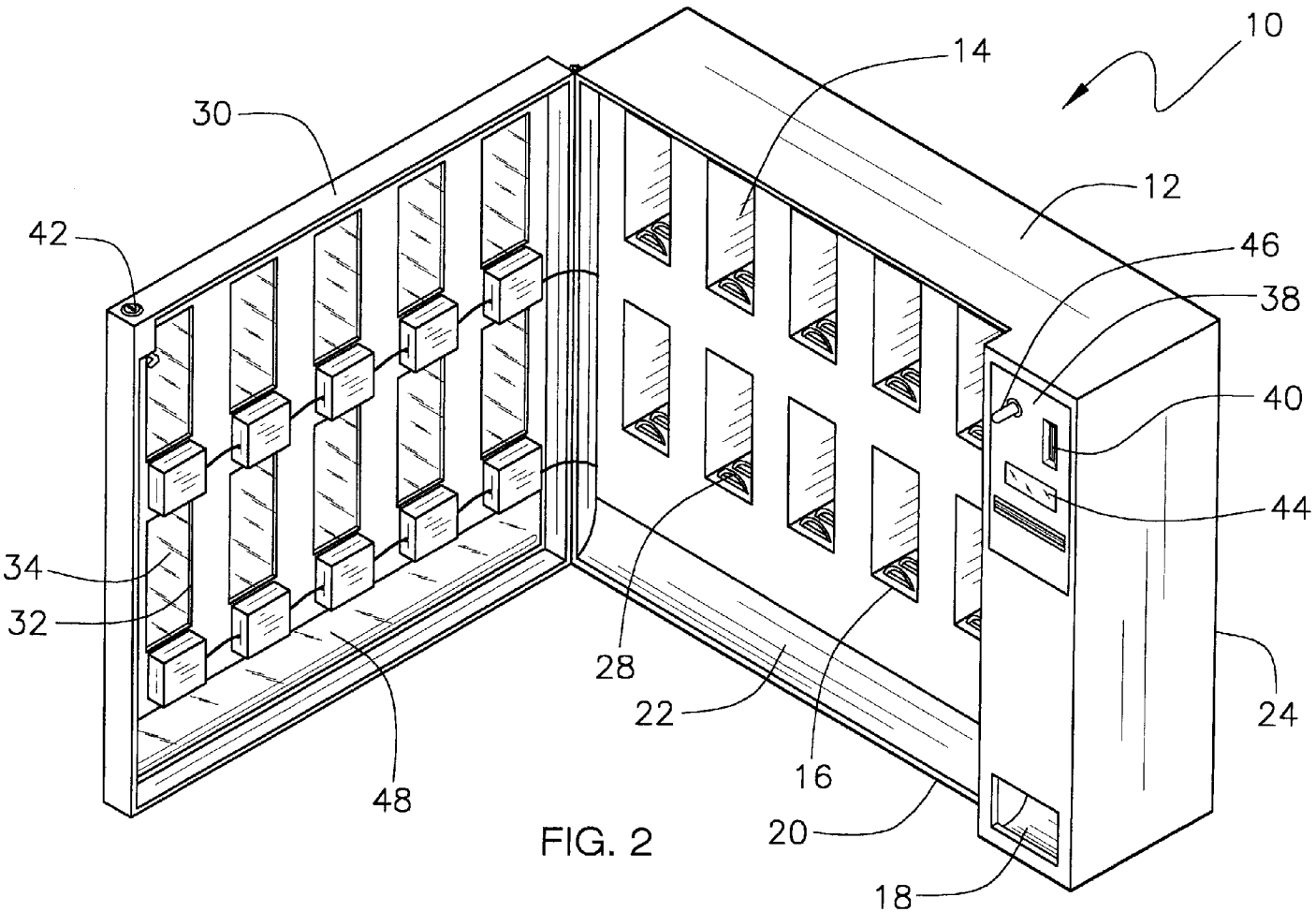
FIG. 2 is a top perspective view of the dental hygiene vending machine of the present invention.

In FIG. 2, the dental hygiene vending machine 10 is illustrated and will be described. More particularly, the dental hygiene vending machine 10 has the housing 12 has the plurality of dispensing compartments 14 therein. The housing dispensing compartments 14 have the bottom 16. The housing 12 has the change return slot 18 therein. The housing 12 has the bottom portion 20. The housing 12 has a dispensing tray channel 22 in the housing bottom portion 20. A dispensing coil 28 is rotatably connected to the housing 12. The dispensing coil 28 is capable of actuation. The cover 30 is hingedly connected to the housing 12. The cover 30 has the plurality of cutouts 32 that substantially align with the housing dispensing compartments 14. The item window 34 is attached to the cover 30. The plurality of dispensing switches 36 are slidably connected to the cover 30. The change counter 38 is connected to the housing 12. The change counter 38 has the coin slot therein 40. The change counter 38 is electrically connected to the dispensing switches 36 (shown in FIG. 1) and is capable of actuating the dispensing coil 28 when the predetermined value of change is received in the coin slot 40. The cover lock 42 is connected to the cover 30 is capable of locking the cover 30 to the housing 12. The amount indicator 44 is connected to the change counter 38 and is capable of displaying the value of change placed within the coin slot 40. The change return switch 46 is connected to the change counter 38 for returning coins inserted into the coin slot 40. The dispensing door 48 is hingably connected to the cover 30. The price display 50 is connected to the cover 30.

Figure 3:
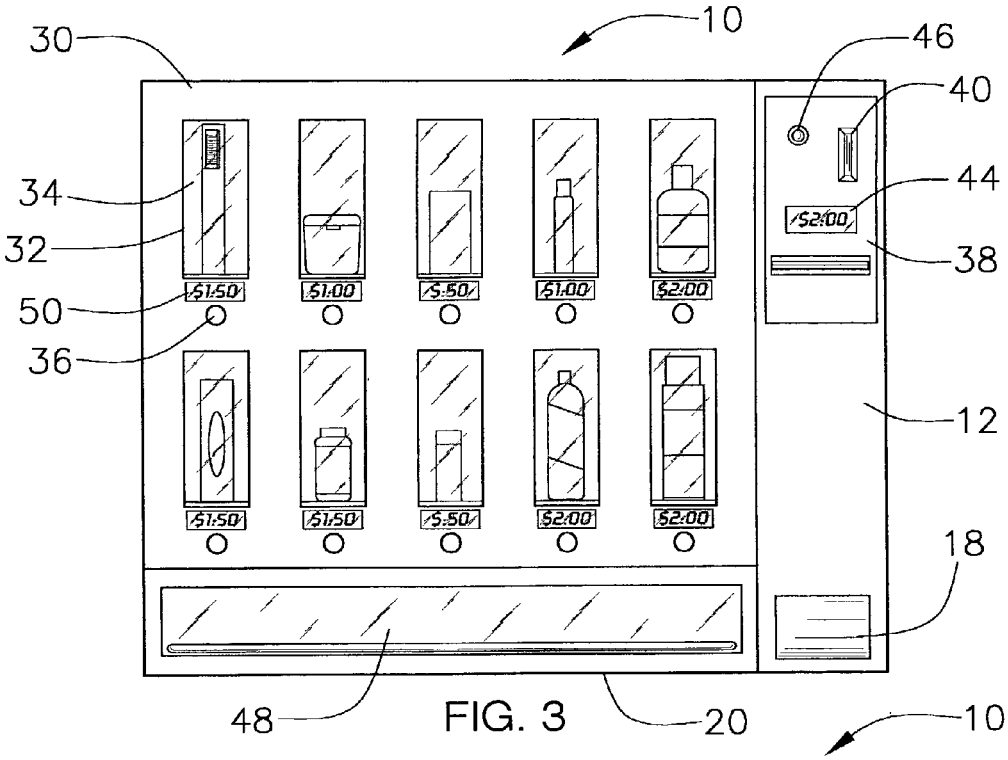
FIG. 3 is a front side view of the dental hygiene vending machine of the present invention.

In FIG. 3, the dental hygiene vending machine 10 is illustrated and will be described. More particularly, the dental hygiene vending machine 10 has the housing 12. The housing 12 has the change return slot 18 therein. The housing 12 has the bottom portion 20. The cover 30 has the plurality of cutouts 32 that substantially align with the housing dispensing compartments 14. The item window 34 is attached to the cover 30. The plurality of dispensing switches 36 are slidably connected to the cover 30. The change counter 38 is connected to the housing 12. The change counter 38 has the coin slot therein 40. The amount indicator 44 is connected to the change counter 38 and is capable of displaying the value of change placed within the coin slot 40. The change return switch 46 is connected to the change counter 38 for returning coins inserted into the coin slot 40. The dispensing door 48 is hingably connected to the cover 30. The price display 50 is connected to the cover 30.

Figure 4:
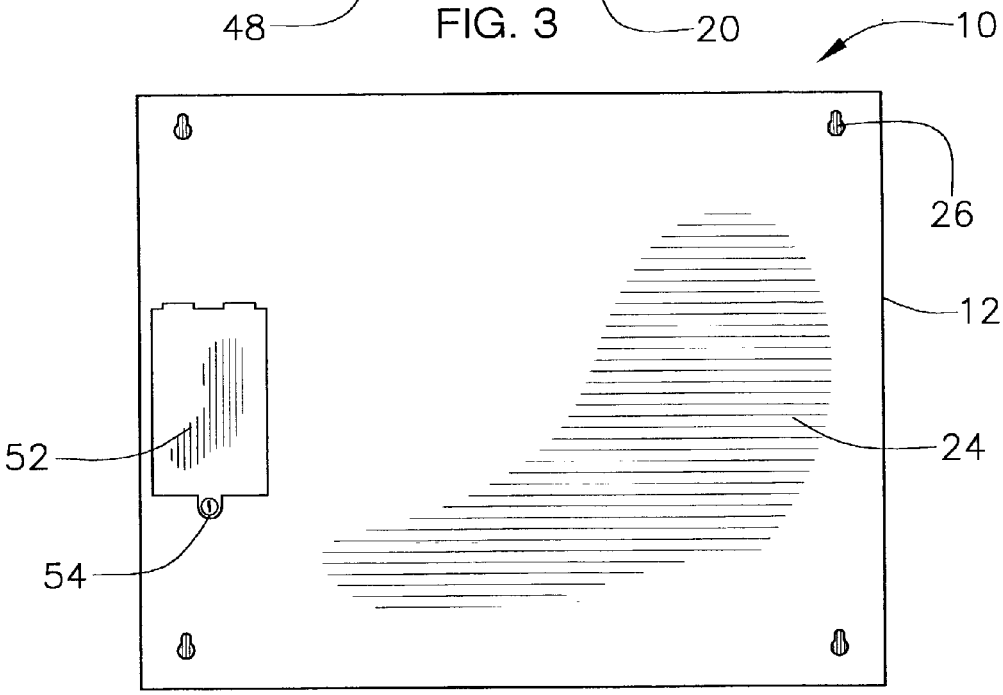
FIG. 4 is a back side view of the dental hygiene vending machine of the present invention.

In FIG. 4, the dental hygiene vending machine 10 is illustrated and will be described. The housing 12 has a back portion 24. The housing back portion 23 has a plurality of hanging slots therein 26. A lock box 52 is connected to the housing 12. A lock box lock 54 is connected to the lock box 52 and is capable of locking to the housing 12.

In use, it can now be understood that the dental hygiene vending machine 10 is used like any conventional vending machine.

While a preferred embodiment of the dental hygiene vending machine has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic or composite may be used instead of the metal housing described. And although vending machine for dispensing dental hygiene products and the like have been described, it should be appreciated that the dental hygiene vending machine herein described is also suitable for dispensing any type of product in a public place.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dental hygiene vending machine comprising:

a housing having a plurality of dispensing compartments therein, said housing dispensing compartments having a bottom;

a dispensing coil rotatably connected to said housing, said dispensing coil capable of actuation;

a cover hingedly connected to said housing, said cover having a plurality of cutouts that substantially align with said housing dispensing compartments;

an item window attached to said cover;

a plurality of dispensing switches slidably connected to said cover;

a change counter connected to said housing, said change counter having a coin slot therein, said change counter electrically connected to said dispensing switches and capable of actuating said dispensing coil when a predetermined value of change is received in said coin slot; and a lock box connected to said housing; and a lock box lock connected to said lock box and capable of locking to said housing.

2. A dental hygiene vending machine comprising:

a housing having a plurality of dispensing compartments therein, said housing dispensing compartments having a bottom, said housing having a back portion, and said housing back portion hanging slots therein, a dispensing coil rotatably connected to said housing, said dispensing coil capable of actuation;

a cover hingedly connected to said housing, said cover having a plurality of cutouts that substantially align with said housing dispensing compartments;

a cover lock connected to said cover is capable of locking said cover to said housing;

an item window attached to said cover;

a plurality of dispensing switches slidably connected to said cover;

a change counter connected to said housing, said change counter having a coin slot therein, said change counter electrically connected to said dispensing switches and capable of actuating said dispensing coil when a predetermined value of change is received in said coin slot; an amount indicator is connected to said change counter and is capable of displaying the value of change placed within said coin slot, said housing having a bottom portion, and said housing having a dispensing tray channel in said housing bottom portion;

a change return switch connected to said change counter for returning coins inserted into said coin slot;

a dispensing door hingably connected to said cover; and a price display connected to said cover, said price display electrically connected to said change counter, wherein said housing having a change return slot therein.

3. The dental hygiene vending machine of claim 2 further comprising:

a lock box connected to said housing; and a lock box lock connected to said lock box and capable of locking to said housing.

4. A dental hygiene vending machine comprising:

a housing having a plurality of dispensing compartments therein, said housing dispensing compartments having a bottom, said housing having a change return slot therein, said housing having a bottom portion, said housing having a dispensing tray channel in said housing bottom portion, said housing having a back portion, said housing back portion having hanging slots therein;

a dispensing coil rotatably connected to said housing, said dispensing coil capable of actuation;

a cover hingedly connected to said housing, said cover having a plurality of cutouts that substantially align with said housing dispensing compartments;

an item window attached to said cover;

a plurality of dispensing switches slidably connected to said cover;

a change counter connected to said housing, said change counter having a coin slot therein, said change counter electrically connected to said dispensing switches and capable of actuating said dispensing coil when a predetermined value of change is received in said coin slot;

a cover lock connected to said cover is capable of locking said cover to said housing;

an amount indicator is connected to said change counter and is capable of displaying the value of change placed within said coin slot;

a change return switch connected to said change counter for returning coins inserted into said coin slot;

a dispensing door hingably connected to said cover;

a price display connected to said cover, said price display electrically connected to said change counter;

a lock box connected to said housing; and a lock box lock connected to said lock box and capable of locking to said housing.

* * * * *